US010501709B2

(12) United States Patent
Auty et al.

(10) Patent No.: US 10,501,709 B2
(45) **Date of Patent: *Dec. 10, 2019**

(54) LAUNDRY LIQUID COMPOSITION

(71) Applicant: Conopco, Inc., Englewood Cliffs, NJ (US)

(72) Inventors: Catherine Mary Auty, Ellesmere Port (GB); Stephen Norman Batchelor, Chester (GB); Jayne Michelle Bird, Ellesmere Port (GB); Matthew Tynan, Harwood (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/548,784

(22) PCT Filed: Feb. 10, 2016

(86) PCT No.: PCT/EP2016/052782

§ 371 (c)(1),
(2) Date: Aug. 4, 2017

(87) PCT Pub. No.: WO2016/128433

PCT Pub. Date: Aug. 18, 2016

(65) Prior Publication Data

US 2018/0237730 A1 Aug. 23, 2018

(30) Foreign Application Priority Data

Feb. 13, 2015 (EP) ..... 15155023

(51) Int. Cl.

| | |
|---|---|
| ***C11D 1/22*** | (2006.01) |
| ***C11D 1/29*** | (2006.01) |
| ***C11D 1/72*** | (2006.01) |
| ***C11D 3/30*** | (2006.01) |
| ***C11D 3/37*** | (2006.01) |
| ***C11D 3/40*** | (2006.01) |
| ***C11D 1/83*** | (2006.01) |
| *C11D 1/04* | (2006.01) |
| *C11D 1/14* | (2006.01) |
| *C11D 1/28* | (2006.01) |

(52) U.S. Cl.

CPC ..... *C11D 3/40* (2013.01); *C11D 1/83* (2013.01); *C11D 3/30* (2013.01); *C11D 3/3723* (2013.01); *C11D 1/04* (2013.01); *C11D 1/146* (2013.01); *C11D 1/22* (2013.01); *C11D 1/28* (2013.01); *C11D 1/29* (2013.01); *C11D 1/72* (2013.01)

(58) Field of Classification Search

CPC ..... C11D 3/30; C11D 3/3723; C11D 3/40; C11D 1/29; C11D 1/83; D06L 1/00

USPC ..... 510/475, 499, 336, 337, 356, 357, 360; 8/137

See application file for complete search history.

(56) References Cited

U.S. PATENT DOCUMENTS

| | | | |
|---|---|---|---|
| 4,182,612 | A | 1/1980 | Sokol et al. |
| 4,962,190 | A | 10/1990 | Mayer |
| 5,565,145 | A | 10/1996 | Watson et al. |
| 5,858,948 | A | 1/1999 | Ghosh et al. |
| 5,968,893 | A | 10/1999 | Manohar et al. |
| 6,004,922 | A | 12/1999 | Watson et al. |
| 6,191,093 | B1 | 2/2001 | Watson et al. |
| 6,291,415 | B1 | 9/2001 | Watson |
| 7,754,671 | B2 | 7/2010 | Lin et al. |
| 8,318,653 | B2 | 11/2012 | Misske et al. |
| 10,081,785 | B2 | 9/2018 | Batchelor et al. |
| 2012/0304399 | A1 | 12/2012 | Batchelor et al. |
| 2016/0215239 | A1 | 7/2016 | Batchelor et al. |

FOREIGN PATENT DOCUMENTS

| | | |
|---|---|---|
| CN | 101768372 | 7/2010 |
| CN | 101855272 | 10/2010 |
| EP | 0317859 | 5/1989 |
| WO | WO97042289 | 11/1997 |
| WO | WO9901530 | 1/1999 |
| WO | WO2009060059 | 5/2009 |
| WO | WO2010148624 | 12/2010 |
| WO | WO2011047987 | 4/2011 |
| WO | WO2012119821 | 9/2012 |
| WO | WO2012119859 | 9/2012 |
| WO | WO2012126665 | 9/2012 |
| WO | WO2013171210 | 11/2013 |
| WO | WO2013171211 | 11/2013 |
| WO | WO2013171212 | 11/2013 |
| WO | WO2015039977 | 3/2015 |
| WO | WO2015110291 | 7/2015 |

OTHER PUBLICATIONS

Search Report & Written Opinion in PCTEP2016052829, dated Apr. 26, 2016.

Search Report and Written Opinion in PCTEP2016052782, dated May 31, 2016.

Search Report and Written Opinion in PCTEP2016052790, dated May 31, 2016.

Search Report and Written Opinion in EP15155021, dated Jul. 21, 2015.

Search Report and Written Opinion in EP15155022, dated Jul. 21, 2015.

Search Report and Written Opinion in EP15155023, dated Jul. 21, 2015.

Co-pending Application: Applicant: Batchelor et al., U.S. Appl. No. 14/915,305, filed Feb. 29, 2016.

Kelu Yan, Course in Dyeing and Finishing Technology, China Textile & Apparel Press, 2005, pp. 222-223, vol. 1 (With translation).

(Continued)

*Primary Examiner* — Gregory R Delcotto

(74) *Attorney, Agent, or Firm* — Greenberg Traurig, LLP

(57) ABSTRACT

The present invention concerns liquid laundry compositions with specific surfactant mixtures and dye polymers covalently bound to a polyethylene imine substituted by groups selected from ethyl alcohol and iso-propyl alcohol. The present invention is also related to a domestic laundry method.

9 Claims, No Drawings

(56) References Cited

OTHER PUBLICATIONS

Search Report & Written Opinion EP13184721, dated Nov. 18, 2013.
Search Report & Written Opinion in EP13184722, dated Nov. 18, 2013.
Search Report & Written Opinion in PCTEP2014069564, dated Nov. 28, 2014.
Search Report & Written Opinion in PCTEP2014069565, dated Nov. 28, 2014.

LAUNDRY LIQUID COMPOSITION

FIELD OF INVENTION

The present invention concerns dye polymers and the use of the dye polymers in liquid laundry compositions with specific surfactant mixtures.

BACKGROUND OF INVENTION

Liquid detergents based on anionic surfactants mixed with non-ionic surfactants are used for the domestic washing of clothes.

Co-pending PCT/EP2014/069565 (C4800) and PCT/EP2015/050239 (C4802) disclose blue or violet dye polymer, comprising a polyethylene imine covalently bound to a reactive dye, the polyethylene imine having from 6 to 1000000 nitrogen atoms, wherein from 20 to 95 mol %, of the totality of the protons of the primary and secondary amine nitrogen atoms of the unsubstituted polyethylene imine are substituted by iso-propyl alcohol or ethyl alcohol groups. Such dye polymers deposits to polyester and cotton clothes under wash conditions and thereby whitening the fabric via a shading effect.

Liquid detergent formulations containing Alkyl Ether Sulphate surfactant are widely used for the domestic washing of clothes.

Cotton clothes can undergoing greater yellowing than polyester, under such conditions it would be desirous to have greater relative deposition of the dye polymer to cotton than polyester fibres to enhance the whiteness.

SUMMARY OF THE INVENTION

In detergents containing alkyl ether sulphate surfactant, the relative deposition efficiency of the dye polymer to cotton over polyester is increased by using Alkyl Ether Sulphate with less than 2 EO group but with at least 1 EO group.

In one aspect the present invention provides a liquid laundry detergent formulation comprising:

(i) from 5 to 70 wt % of a mixture of anionic and non-ionic surfactant, wherein the fraction (wt % anionic)/(wt % non-ionic) is at least 1 and the anionic surfactants are chosen such that the fraction (wt % alkyl ether sulphate)/(wt % total anionic surfactant) is at least 0.5 and the alkyl ether sulphate has from 1.0 EO to 1.9 EO; and, (ii) from 0.001 to 2.0 wt % of a dye polymer, the dye polymer comprising a polyethylene imine covalently bound to a reactive dye, the polyethylene imine having from 6 to 1000000 amine nitrogen atoms, wherein from 20 to 98 mol % of the totality of the protons of the primary and secondary amine nitrogen atoms of the unsubstituted polyethylene imine are substituted by groups selected from ethyl alcohol and iso-propyl alcohol.

In another aspect the present invention provides a domestic laundry method, the method comprising the steps of:

(i) washing laundry with an aqueous solution of the liquid detergent formulation as defined herein, the aqueous solution comprising from 10 ppb to 5000 ppm of the dye polymer; and, from 0.1 g/L to 6 g/L of the surfactant mixture; and, (ii) optionally rinsing and drying the laundry.

All weight % (wt %) of anionic surfactants are calculated as their sodium salts. For example if 8.0 wt % C13 linear alkyl benzene sulfonic acid is added to a formulation, this corresponds to a value of 8.5 wt % when expressed as the sodium salt.

DETAILED DESCRIPTION OF THE INVENTION

Dye

The reactive dye is blue or violet. Deposition of blue or violet dyes to fabrics enhances the perception of whiteness of white fabrics.

Many Reactive dyes are listed in the Colour Index (Society of Dyers and Colourists/American Association of Textile Chemists and Colorists). Reactive dyes are discussed in Industrial Dyes (edited by K. Hunger).

The reactive dye comprises a chromophore covalently linked to one or more reactive groups. The reactive group reacts with an amine or hydroxyl (OH) group, preferably an NH of the polymer to covalently bind the dye to the dye polymer. The amine is far more nucleophilic than the hydroxyl group and will preferentially react with the reactive dye. For example, for an $NH_2$ group as illustrated below:

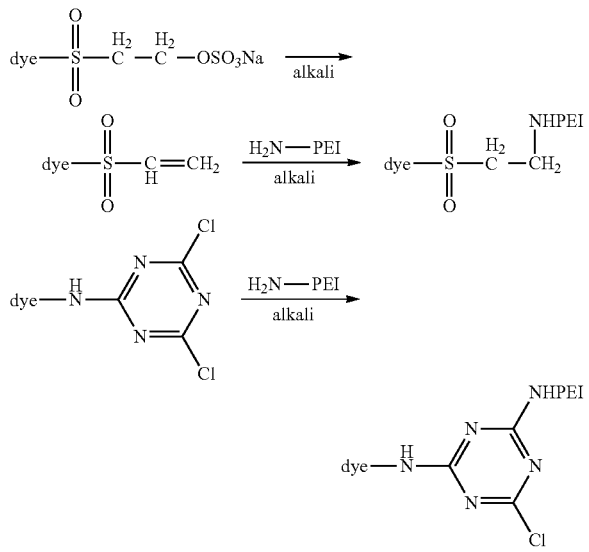

-continued

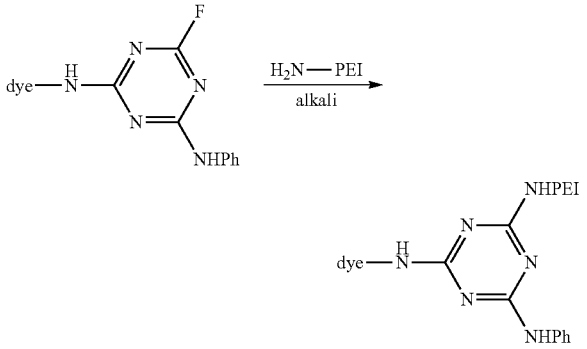

Chromophores may be selected from anthraquinone, phenazine, triphenodioxazine, mono-azo, bis-azo, polyazo, formazan and phthalocyanin.

The reactive group is preferably selected from heterocyclic reactive groups; 2-bromoprop-2-enamido; 2,3-dibromopropanamido; and, a sulfooxyethylsulfonyl reactive group ($—SO_2CH_2CH_2OSO_3Na$).

2-bromoprop-2-enamido reactive group has the structure:

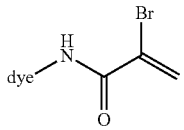

2,3-dibromopropanamido reactive group has the structure:

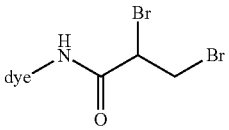

The heterocyclic reactive groups are preferably nitrogen containing aromatic rings bound to a halogen or an ammonium group, which react with $NH_2$ or NH groups of the polymers to form a covalent bond. The halogen is preferred. More preferred heterocylic reactive groups are dichlorotriazinyl, difluorochloropyrimidine, monofluorotrazinyl, monofluorochlorotrazinyl, dichloroquinoxaline, difluorotriazine, monochlorotriazinyl, and trichloropyrimidine.

The reactive group may be linked to the dye chromophore via an alkyl spacer for example: dye-NH—$CH_2CH_2$-reactive group.

Especially preferred heterocylic reactive groups are:

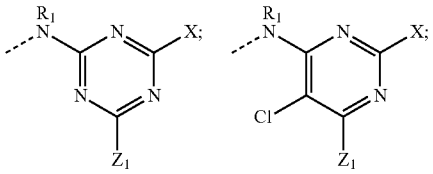

-continued

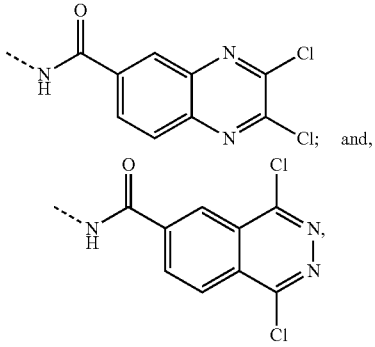

wherein $R_1$ is selected from H or alkyl, preferably H.

X is selected from F or Cl.

When X=Cl, $Z_1$ is selected from —Cl, $—NR_2R_3$, $—OR_2$, $—SO_3Na$

When X=F, $Z_1$ is selected from $—NR_2R_3$ $R_2$ and $R_3$ are independently selected from H, alkyl and aryl groups. Aryl groups are preferably phenyl and are preferably substituted by $—SO_3Na$ or $—SO_2CH_2CH_2OSO_3Na$. Alkyl groups are preferably methyl or ethyl.

The reactive dye is preferably selected from mono-azo, bis-azo and anthraquinone dyes, most preferably anthraquinone dyes.

The reactive anthraquinone dye comprises an anthraquinone dye covalently linked to a reactive group. The reactive group reacts with an NH of the polymer to covalently bind the dye to the polymer.

A most preferred anthraquinone dye structure is:

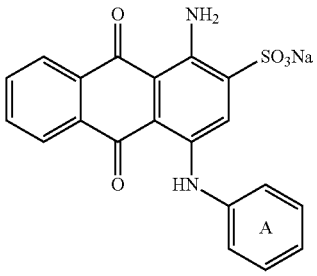

Where the A ring is substituted by a reactive group. Preferably the A ring is substituted by a reactive group selected from: dichlorotriazinyl; difluorochloropyrimidine; monofluorotrazinyl; monofluorochlorotrazinyl; dichloroquinoxaline; difluorotriazine; monochlorotriazinyl; trichloropyrimidine 2-bromoprop-2-enamido; 2,3-dibromopropanamido; and, a sulfooxyethylsulfonyl reactive group ($—SO_2CH_2CH_2OSO_3Na$).

The A ring may be further substituted by organic groups preferably selected from alkyl and $SO_3Na$. The alkyl group is preferably C1-C8-alkyl, most preferably methyl.

Preferred reactive anthraquinone dyes are: Reactive blue 1; Reactive blue 2; Reactive blue 4; Reactive blue 5; Reactive blue 6; Reactive blue 12; Reactive blue 16; reactive blue 19; Reactive blue 24; Reactive blue 27; Reactive blue 29; Reactive blue 36; Reactive blue 44; Reactive blue 46; Reactive blue 47; reactive blue 49; Reactive blue 50; Reactive blue 53; Reactive blue 55; Reactive blue 61; Reactive blue 66; Reactive blue 68; Reactive blue 69; Reactive blue 74; Reactive blue 86; Reactive blue 93; Reactive blue 94; Reactive blue 101; Reactive blue 103; Reactive blue 114; Reactive blue 117; Reactive blue 125; Reactive blue 141; Reactive blue 142; Reactive blue 145; Reactive blue 149; Reactive blue 155; Reactive blue 164; Reactive blue 166; Reactive blue 177; Reactive blue 181; Reactive blue 185; Reactive blue 188; Reactive blue 189; Reactive blue 206; Reactive blue 208; Reactive blue 246; Reactive blue 247; Reactive blue 258; Reactive blue 261; Reactive blue 262; Reactive blue 263; Reactive blue 172; Reactive Violet 22; Reactive Violet 31; and, Reactive Violet 34.

The dyes are listed according to Colour Index (Society of Dyers and Colourists/American Association of Textile Chemists and Colorists) classification.

Reactive Red Dye

A Reactive Red dye may also be bound to the polymer preferably in a mol ratio of 1:100 to 1:4 with the anthraquinone reactive dye. This provides a more violet red shade to the polymer. The Reactive Red dye is preferably a mono-azo dye.

PEI Polymer

Polyethyleneimines (PEI) are formed by ring opening polymerisation of ethyleneimine.

PEI's are usually highly branched polyamines characterized by the empirical formula $(C_2H_5N)_n$ with a molecular mass of 43.07 (as repeating units). They are commercially prepared by acid-catalyzed ring opening of ethyleneimine, also known as aziridine. (The latter, ethyleneimine, is prepared through the sulphuric acid esterification of ethanolamine).

All polyethylene imine (PEIs) of the present invention contain primary and secondary amines. Preferably tertiary amines are present in the PEI.

The Nitrogen of the dye-polymer may be further substituted by other groups, for example an alkyl group, or an alkyl sulphate group, or an alkyl aryl group or an alkyl aryl sulphate group.

Dye-Polymer

The unsubstituted polyethylene imine is the polyethylene imine before reaction with the reactive dye or ethoxylation/propoxylation. From an unsubstituted polyethylene imine an ethoxylated/propoxylated polyethylene imine (polyethylene imine substituted by ethyl alcohol/iso-propyl alcohol groups) is formed, this ethoxylated/propoxylated polyethylene imine is then reacted with a reactive dye. Alternatively, an unsubstituted polyethylene imine is reacted with a reactive dye which is subsequently ethoxylated/propoxylated. A mixture of ethoxylation and propoxylation may be used.

Propoxylation is preferred.

It is evident from the present disclosure that ethoxylation/propoxylation of the polyethylene imine provides —$CH_2$—$CH_2OH$/—$CH_2$—CH(OH)—$CH_3$ substituent such that the unsubstituted polyethylene imine is substituted by ethyl alcohol/iso-propyl alcohol groups.

The propoxylation is preferably accomplished by the reaction of polymer with propylene oxide, for example:

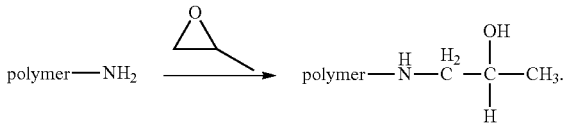

In a similar manner to the reaction above ethylene oxide is used for ethoxylation. An example synthesis of the dye-polymer is shown below (structure 1)

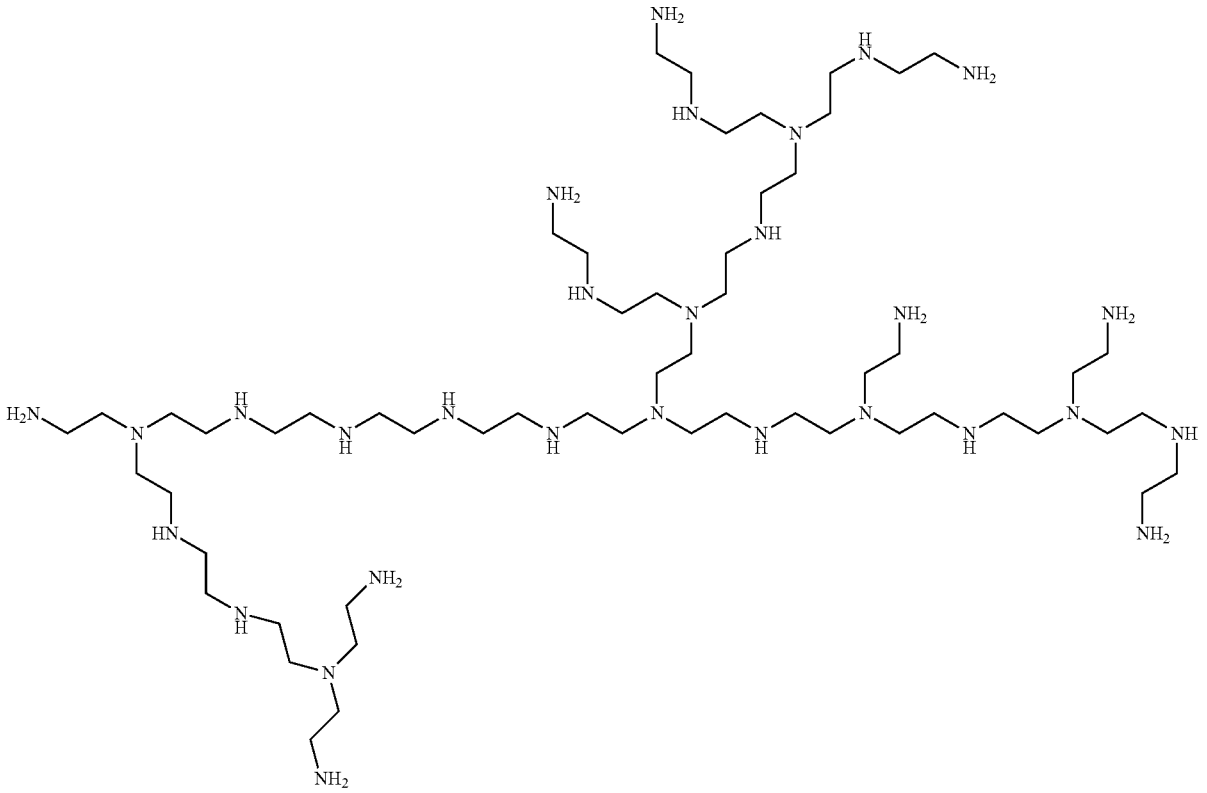

An unsubstituted PEI (structure 1) containing 29 nitrogen atoms of which 9 are primary (i.e. $NH_2$), 13 are secondary (i.e. NH) and 7 are tertiary, is reacted with 26 mol equivalents of propylene oxide to give the structure below (structure 2).

Preferably 57 to 80 mol % of the protons of the primary and secondary amine nitrogen atoms are substituted by ethyl alcohol or iso-propyl alcohol groups.

The unsubstituted PEI (structure 1) contained (2×9)+(1×13)=31 protons of the primary and secondary nitrogens. When reacted with 26 mol equivalents of propylene oxide, 26/31×100=83.9 mol % of the protons of the primary and secondary nitrogens have been replaced by an iso-propyl alcohol groups (structure 2).

(structure 2)

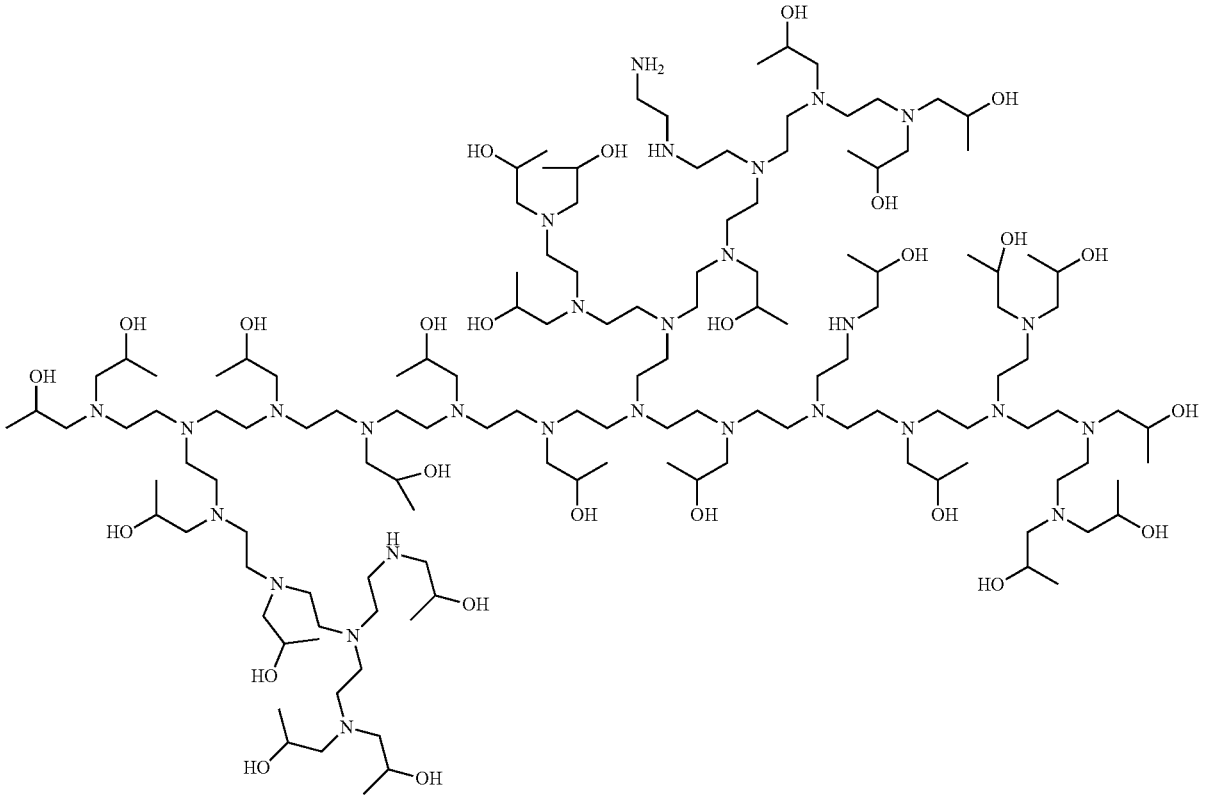

The propoxylated PEI (structure 2) is then reacted with 1 mol equivalent of the dye Reactive Blue 49 to produce a preferred dye-polymer (structure 3) of the invention.

(structure 3)

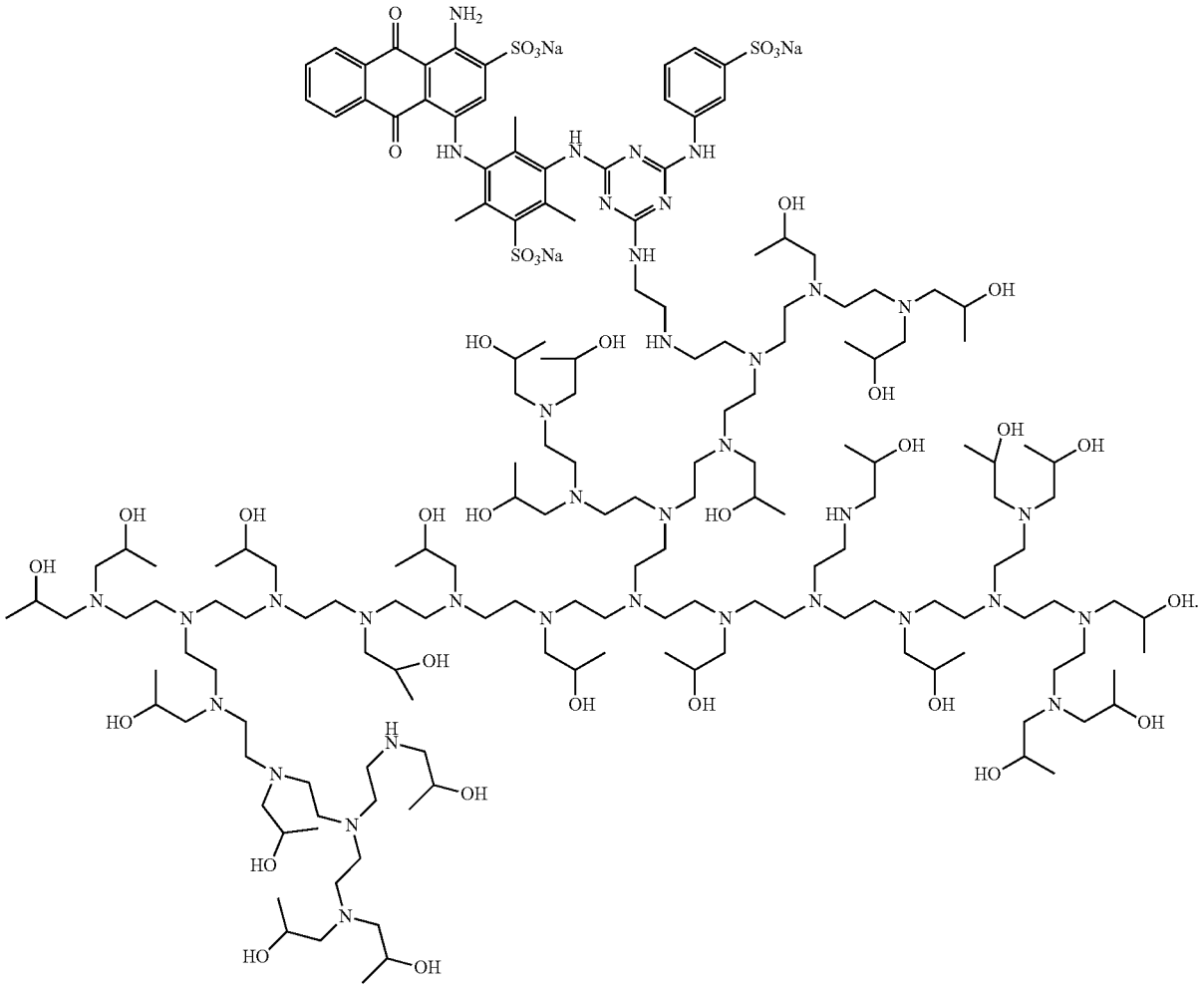

In above structure the illustrated the propoxylated PEI carries one dye chromophore. The dye polymers can carry a plurality of reactive dyes.

The reactive group of the reactive dye preferably reacts with an NH group of the ethoxylated/propoxylated PEI.

Preferably the dye-polymer contains 1 to 40 wt % of dye. In structure 3 the molecular weight of the dye polymer is 3578.7 of which 846.7 is the dye, the wt % of dye on the dye-polymer is 846.7/3578.7×100=23.65 wt %.

When the polyethylene imine has from 10 to 200, most preferably from 15 to 45, amine nitrogen atoms, the mole ratio of reactive dye to polymer is preferably from 0.8:1 to 1.5:1.

Reactive dyes with 2 reactive groups may cross-link the polymer, so that it is attached to 2 polymer chains. Preferably the reactive dye is only attached to one polymer. Preferably the reactive dye only contains one reactive group.

Surfactant

The laundry composition comprises from 5 to 70 wt % of a surfactant, most preferably 10 to 30 wt %. In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981. Preferably the surfactants have saturated alkyl chains.

Suitable nonionic surfactants which may be used include, in particular, the reaction products of compounds having a hydrophobic group and a reactive hydrogen atom, for example, aliphatic alcohols, acids, or amides with alkylene oxides, especially ethylene oxide either alone or with propylene oxide. Preferred nonionic detergent compounds are the condensation products of aliphatic $C_8$ to $C_{18}$ primary or secondary linear or branched alcohols with ethylene oxide (EO), generally 5 to 40 EO, preferably 7EO to 9EO. Strylphenol ethoxylate are also preferred non-ionic detergent compounds.

Suitable anionic surfactants which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$ to $C_{18}$ alcohols, produced for example from tallow or coconut oil, sodium and potassium alkyl $C_9$ to $C_{20}$ benzene sulphonates, particularly sodium linear secondary alkyl $C_{10}$ to $C_{15}$ benzene sulphonates; alkyl ether sulphate and sodium alkyl glyceryl ether sulphates, especially those ethers of the higher alcohols derived from tallow or coconut oil and synthetic alcohols derived from petroleum. Amine salts of the anionic surfactants may be used.

The anionic surfactants are preferably selected from: alkyl ether sulphate (AES); primary alkyl sulphate PAS, soap; methyl ester sulfonate (MES); and, linear alkylbenzene sulfonate (LAS).

Sodium lauryl ether sulphate (SLES) is a preferred AES.

Preferably the fraction (wt % anionic)/(wt % non-ionic) is from 2 to 5, more preferably from 3 to 4.5; this fraction is particularly preferred in conjunction with the fraction (wt % Sodium alkyl ether sulphate)/(wt % total anionic surfactant) from 0.7 to 1.

Complexing Agents

Builder materials may be selected from 1) calcium sequestrant materials, 2) precipitating materials, 3) calcium ion-exchange materials and 4) mixtures thereof. Examples of calcium sequestrant builder materials include alkali metal polyphosphates, such as sodium tripolyphosphate and organic sequestrants, such as ethylene diamine tetra-acetic acid.

Fluorescent Agent

The composition preferably comprises a fluorescent agent (optical brightener). Fluorescent agents are well known and many such fluorescent agents are available commercially. Usually, these fluorescent agents are supplied and used in the form of their alkali metal salts, for example, the sodium salts. The total amount of the fluorescent agent or agents used in the composition is generally from 0.005 to 2 wt %, more preferably 0.01 to 0.5 wt %. Preferred classes of fluorescer are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Blankophor SN. Di-styryl biphenyl compounds are most preferred. Preferred fluorescers are: sodium 2 (4-styryl-3-sulfophenyl)-2H-napthol[1,2-d]triazole, disodium 4,4'-bis {[(4-anilino-6-(N methyl-N-2 hydroxyethyl) amino 1,3,5-triazin-2-yl)]amino}stilbene-2-2' disulfonate, disodium 4,4'-bis{[(4-anilino-6-morpholino-1,3,5-triazin-2-yl)]amino} stilbene-2-2' disulfonate, and disodium 4,4'-bis(2-sulfostyryl)biphenyl.

It is preferred that the aqueous solution used in the method has a fluorescer present. When a fluorescer is present in the aqueous solution used in the method it is preferably in the range from 0.0001 g/l to 0.1 g/l, preferably 0.001 to 0.02 g/l.

Perfume

Preferably the composition comprises a perfume. The perfume is preferably in the range from 0.001 to 3 wt %, most preferably 0.1 to 1 wt %. Many suitable examples of perfumes are provided in the CTFA (Cosmetic, Toiletry and Fragrance Association) 1992 International Buyers Guide, published by CFTA Publications and OPD 1993 Chemicals Buyers Directory 80th Annual Edition, published by Schnell Publishing Co.

It is commonplace for a plurality of perfume components to be present in a formulation. In the compositions of the present invention it is envisaged that there will be four or more, preferably five or more, more preferably six or more or even seven or more different perfume components.

In perfume mixtures preferably 15 to 25 wt % are top notes. Top notes are defined by Poucher (Journal of the Society of Cosmetic Chemists 6(2):80 [1955]). Preferred top-notes are selected from citrus oils, linalool, linalyl acetate, lavender, dihydromyrcenol, rose oxide and cis-3-hexanol.

Perfume and top note may be used to cue the whiteness benefit of the invention.

Glycerol and other agents may be added to give the product the desired viscosity.

Polymers

The composition may comprise one or more further polymers. Examples are carboxymethylcellulose, poly (ethylene glycol), poly(vinyl alcohol), polycarboxylates such as polyacrylates, maleic/acrylic acid copolymers and lauryl methacrylate/acrylic acid copolymers.

Polymers present to prevent dye deposition, for example poly(vinylpyrrolidone), poly(vinylpyridine-N-oxide), and poly(vinylimidazole), are preferably absent from the formulation.

Enzymes

One or more enzymes are preferred present in a laundry composition of the invention and when practicing a method of the invention.

Preferably the level of each enzyme in the laundry composition of the invention is from 0.0001 wt % to 0.1 wt % protein.

Especially contemplated enzymes include proteases, alpha-amylases, cellulases, lipases, peroxidases/oxidases, pectate lyases, and mannanases, or mixtures thereof.

Suitable lipases include those of bacterial or fungal origin. Chemically modified or protein engineered mutants are included. Examples of useful lipases include lipases from *Humicola* (synonym *Thermomyces*), e.g. from *H. lanuginosa* (*T. lanuginosus*) as described in EP 258 068 and EP 305 216 or from *H. insolens* as described in WO 96/13580, a *Pseudomonas* lipase, e.g. from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), a *Bacillus* lipase, e.g. from *B. subtilis* (Dartois et al. (1993), Biochemica et Biophysica Acta, 1131, 253-360), *B. stearothermophilus* (JP 64/744992) or *B. pumilus* (WO 91/16422).

Other examples are lipase variants such as those described in WO 92/05249, WO 94/01541, EP 407 225, EP 260 105, WO 95/35381, WO 96/00292, WO 95/30744, WO 94/25578, WO 95/14783, WO 95/22615, WO 97/04079 and WO 97/07202, WO 00/60063.

Preferred commercially available lipase enzymes include Lipolase™ and Lipolase Ultra™, Lipex™ and Lipoclean™ (Novozymes A/S).

The method of the invention may be carried out in the presence of phospholipase classified as EC 3.1.1.4 and/or EC 3.1.1.32. As used herein, the term phospholipase is an enzyme which has activity towards phospholipids.

Phospholipids, such as lecithin or phosphatidylcholine, consist of glycerol esterified with two fatty acids in an outer (sn-1) and the middle (sn-2) positions and esterified with phosphoric acid in the third position; the phosphoric acid, in turn, may be esterified to an amino-alcohol. Phospholipases are enzymes which participate in the hydrolysis of phospholipids. Several types of phospholipase activity can be distinguished, including phospholipases $A_1$ and $A_2$ which hydrolyze one fatty acyl group (in the sn-1 and sn-2 position, respectively) to form lysophospholipid; and lysophospholipase (or phospholipase B) which can hydrolyze the remaining fatty acyl group in lysophospholipid. Phospholipase C and phospholipase D (phosphodiesterases) release diacyl glycerol or phosphatidic acid respectively.

The enzyme and the shading dye may show some interaction and should be chosen such that this interaction is not negative. Some negative interactions may be avoided by encapsulation of one or other of enzyme or shading dye and/or other segregation within the product.

Suitable proteases include those of animal, vegetable or microbial origin. Microbial origin is preferred. Chemically modified or protein engineered mutants are included. The protease may be a serine protease or a metallo protease, preferably an alkaline microbial protease or a trypsin-like protease. Preferred commercially available protease enzymes include Alcalase™, Savinase™, Primase™, Duralase™ Dyrazym™, Esperase™, Everlase™, Polarzyme™, and Kannase™, (Novozymes NS), Maxatase™, Maxacal™, Maxapem™, Properase™, Purafect™, Purafect OxP™, FN2™, and FN3™ (Genencor International Inc.).

The method of the invention may be carried out in the presence of cutinase; classified in EC 3.1.1.74. The cutinase used according to the invention may be of any origin. Preferably cutinases are of microbial origin, in particular of bacterial, of fungal or of yeast origin.

Suitable amylases (alpha and/or beta) include those of bacterial or fungal origin. Chemically modified or protein engineered mutants are included. Amylases include, for example, alpha-amylases obtained from *Bacillus*, e.g. a special strain of *B. licheniformis*, described in more detail in GB 1,296,839, or the *Bacillus* sp. strains disclosed in WO 95/026397 or WO 00/060060. Commercially available amylases are Duramyl™, Termamyl™, Termamyl Ultra™, Natalase™, Stainzyme™, Fungamyl™ and BAN™ (Novozymes A/S), Rapidase™ and Purastar™ (from Genencor International Inc.).

Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g. the fungal cellulases produced from *Humicola insolens, Thielavia terrestris, Myceliophthora thermophila*, and *Fusarium oxysporum* disclosed in U.S. Pat. Nos. 4,435,307, 5,648,263, 5,691,178, 5,776,757, WO 89/09259, WO 96/029397, and WO 98/012307. Commercially available cellulases include Celluzyme™ Carezyme™, Celluclean™, Endolase™, Renozyme™ (Novozymes NS), Clazinase™ and Puradax HA™ (Genencor International Inc.), and KAC-500(B)™ (Kao Corporation).

Suitable peroxidases/oxidases include those of plant, bacterial or fungal origin. Chemically modified or protein engineered mutants are included. Examples of useful peroxidases include peroxidases from *Coprinus*, e.g. from *C. cinereus*, and variants thereof as those described in WO 93/24618, WO 95/10602, and WO 98/15257. Commercially available peroxidases include Guardzyme™ and Novozym™ 51004 (Novozymes NS).

Further enzymes suitable for use are discussed in WO2009/087524, WO2009/090576, WO2009/107091, WO2009/111258 and WO2009/148983.

Enzyme Stabilizers

Any enzyme present in the composition may be stabilized using conventional stabilizing agents, e.g., a polyol such as propylene glycol or glycerol, a sugar or sugar alcohol, lactic acid, boric acid, or a boric acid derivative, e.g., an aromatic borate ester, or a phenyl boronic acid derivative such as 4-formylphenyl boronic acid, and the composition may be formulated as described in e.g. WO 92/19709 and WO 92/19708.

Where alkyl groups are sufficiently long to form branched or cyclic chains, the alkyl groups encompass branched, cyclic and linear alkyl chains. The alkyl groups are preferably linear or branched, most preferably linear.

The indefinite article "a" or "an" and its corresponding definite article "the" as used herein means at least one, or one or more, unless specified otherwise.

Preferably the laundry treatment composition is in a plastic bottle or unit dose pouch.

The liquid detergent may be contained within a unit dose, for example 20 ml of liquid contained within a polyvinyl alcohol film. Within liquid detergents the dye-polymers have the additional advantage of showing low staining to fabric on neat contact of the liquid with fabric.

Preferably the composition is dissolved in the wash liquor at 1 to 6 g/L. Preferably the pH of the composition when dissolved in water at 2 g/L is in the range 7 to 9.

Domestic wash conditions include, hand washing clothes in water at temperatures of 278 to 335K, preferably 283K to 305K and machine washing in front loading or top loading washing machine at water temperatures of from 278 to 368, preferably 283 to 335K.

Examples

Separately Knitted white polyester fabric and woven cotton fabric were agitated for 30 minutes in an aqueous solution (13° French Hard, room temperature) containing 0.3 g/L of surfactant. This represents domestic washing of clothes using a liquids detergent product dosed at 3 g/L containing 10 wt % surfactant. PPEI-RB was added to the wash to give a concentration of 7.5 ppm. PPEI-RB is the dye polymer of structure 3. The Liquor to cloth ratio (L:C) in the experiment was 45:1 and after the wash the cloth was rinsed twice in 13° French Hard water. The processes was repeated twice more to give 3 washes in total. The cloth was dried and the colour of the cloth measured and expressed as the CIE L*a*b* value. The surfactant types were varied and the change in the deposition of PPEI-RB monitored using the b* values which measure the yellow-blue colour axis. A more negative b* indicates the cloth is bluer and more PPEI-RB has deposited on the cloth. The dye deposition ratio, φ, was calculated using the formula $$\varphi=(b^*\text{value cotton})/(b^*\text{value polyester})$$

Higher values of φ indicate more relative deposition to the cotton fabric.

The surfactant composition was varied to investigate the effect on deposition.

The anionic surfactants used were Sodium lauryl ether sulphate (SLES) with an average of 3 moles ethylene oxide (3EO) and 1 mole ethylene oxide (1EO) per 1 mole surfactant. The non-ionic used were an Alcohol ethoxylate (C12-C15 primary alcohol with 7 moles of ethoxylate (7EO)) and with 9 moles of ethoxylate (9EO). The results are summarised below.

| | φ | |
|---|---|---|
| Surfactant Formulation | SLES(1EO) inventive | SLES(3EO) comparative |
| 100% SLES | 1.43 | 0.84 |
| 80% SLES, 20% NI(7EO) | 1.12 | 0.93 |
| 60% SLES, 20% LAS, 20% NI(7EO) | 1.32 | 0.99 |
| 40% SLES, 40% LAS, 20% NI(7EO) | 1.54 | 1.39 |
| 60% SLES, 20% LAS, 20% NI(9EO) | 1.16 | 0.87 |

The φ values are higher for the SLES (1EO) containing formulation than the corresponding SLES (3EO) formulation. In the formulation greatest relative deposition to cotton is obtained for SLES (1EO) than SLES (3EO).

The invention claimed is:

1. A liquid laundry detergent formulation comprising:

(i) from 5 to 70 wt % of a mixture of anionic and non-ionic surfactant, wherein the fraction wt % anionic/wt % nonionic is at least 1 and the anionic surfactants are chosen such that the fraction wt % alkyl ether sulphate/wt % total anionic surfactant is at least 0.5 and the alkyl ether sulphate has from 1.0 EO to 1.9 EO; and, (ii) from 0.001 to 2.0 wt % of a dye polymer, the dye polymer comprising a polyethylene imine covalently bound to a reactive dye, the polyethylene imine having from 6 to 1000000 amine nitrogen atoms, wherein from 57 to 98 mol % of the totality of the protons of the primary and secondary amine nitrogen atoms of the unsubstituted polyethylene imine are substituted by iso-propyl alcohol groups; wherein the reactive dye is an anthraquinone dye of the form:

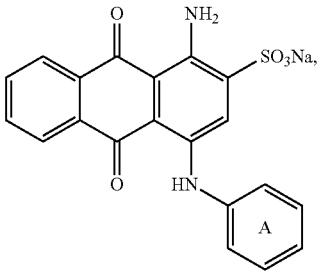

wherein the A ring is substituted by a reactive group selected from: dichlorotriazinyl; difluorochloropyrimidine; monofluorotrazinyl; monofluorochlorotrazinyl; dichloroquinoxaline; difluorotriazine; monochlorotriazinyl; trichloropyrimidine 2-bromoprop-2-enamido; dibromopropanamido; and, a sulfooxyethylsulfonyl reactive group which is —$SO_2CH_2CH_2OSO_3Na$.

2. A liquid detergent formulation according to claim 1, wherein the A ring is further substituted by one or more organic groups selected from: the group consisting of C1-C8-alkyl; and, $SO_3Na$.

3. A liquid detergent formulation according to claim 1, wherein the dye is selected from the group consisting of: Reactive blue 1; Reactive blue 2; Reactive blue 4; Reactive blue 5; Reactive blue 6; Reactive blue 12; Reactive blue 16; Reactive blue 19; Reactive blue 24; Reactive blue 27; Reactive blue 29; Reactive blue 36; Reactive blue 44; Reactive blue 46; Reactive blue 47; Reactive blue 49; Reactive blue 50; Reactive blue 53; Reactive blue 55; Reactive blue 61; Reactive blue 66; Reactive blue 68; Reactive blue 69; Reactive blue 74; Reactive blue 86; Reactive blue 93; Reactive blue 94; Reactive blue 101; Reactive blue 103; Reactive blue 114; Reactive blue 117; Reactive blue 125; Reactive blue 141; Reactive blue 142; Reactive blue 145; Reactive blue 149; Reactive blue 155; Reactive blue 164; Reactive blue 166; Reactive blue 177; Reactive blue 181; Reactive blue 185; Reactive blue 188; Reactive blue 189; Reactive blue 206; Reactive blue 208; Reactive blue 246; Reactive blue 247; Reactive blue 258; Reactive blue 261; Reactive blue 262; Reactive blue 263; Reactive blue 172; Reactive Violet 22; Reactive Violet 31; and, Reactive Violet 34.

4. A liquid detergent formulation according to claim 1, wherein the polyethylene imine comprises from 15 to 45 amine nitrogen atoms.

5. A liquid detergent formulation according to claim 1, wherein 57 to 80 mol % of the protons of the primary and secondary amine nitrogen atoms are substituted by iso-propyl alcohol groups.

6. A liquid detergent formulation according to claim 1, wherein the liquid detergent comprises from 10 to 30 wt % of the mixture of anionic and non-ionic surfactant.

7. A liquid detergent formulation according to claim 1, wherein the fraction wt % anionic/wt % nonionic is from 2 to 5 and wherein the fraction wt % alkyl ether sulphate/wt % total anionic surfactant from 0.7 to 1.

8. A liquid detergent formulation according to claim 1, wherein the anionic surfactants are selected from the group consisting of: alkyl ether sulphate (AES); primary alkyl sulphate PAS; soap; methyl ester sulfonate (MES); and, linear alkylbenzene sulfonate (LAS).

9. A domestic laundry method, the method comprising the steps of:

(i) washing laundry with an aqueous solution of the liquid detergent formulation as defined in claim 1, the aqueous solution comprising from 10 ppb to 5000 ppm of the dye polymer; and, from 0.1 g/L to 6 g/L of the surfactant mixture; and, (ii) optionally rinsing and drying the laundry.

* * * * *